US010895005B2

(12) United States Patent
Park et al.

(10) Patent No.: US 10,895,005 B2
(45) Date of Patent: Jan. 19, 2021

(54) METALLIC GLASS COMPOSITES WITH CONTROLLABLE WORK-HARDENING CAPACITY

(71) Applicant: Seoul National University R&DB Foundation, Seoul (KR)

(72) Inventors: Eun Soo Park, Suwon (KR); Wookha Ryu, Gyeongsan (KR); Hyun Seok Oh, Seoul (KR); Jinwoo Kim, Seoul (KR); So Yeon Kim, Anyang (KR)

(73) Assignee: SEOUL NATIONAL UNIVERSITY R & DB FOUNDATION, Seoul (KR)

( * ) Notice: Subject to any disclaimer, the term of this patent is extended or adjusted under 35 U.S.C. 154(b) by 185 days.

(21) Appl. No.: 16/106,232

(22) Filed: Aug. 21, 2018

(65) Prior Publication Data

US 2019/0062884 A1 Feb. 28, 2019

Related U.S. Application Data

(63) Continuation of application No. 15/287,693, filed on Oct. 6, 2016, now abandoned.

(30) Foreign Application Priority Data

Oct. 7, 2015 (KR) ..... 10-2015-0141240

(51) Int. Cl.
*C22C 1/00* (2006.01)
*C22C 45/10* (2006.01)
*C22C 45/00* (2006.01)

(52) U.S. Cl.
CPC ..... *C22C 45/10* (2013.01); *C22C 1/002* (2013.01); *C22C 45/001* (2013.01)

(58) Field of Classification Search
None
See application file for complete search history.

(56) References Cited

U.S. PATENT DOCUMENTS

2013/0333814 A1 12/2013 Fleury et al.
2017/0043393 A1* 2/2017 Doi ..... B22D 27/02

FOREIGN PATENT DOCUMENTS

CN 102978541 3/2013
CN 104911512 9/2015
(Continued)

OTHER PUBLICATIONS

Calin, M. et al., "Improved mechanical behavior of Cu-Ti-based bulk metallic glass by in situ formation of nanoscale precipitates", Scripta Materialia, vol. 48, pp. 653-658, published 2003.*
(Continued)

*Primary Examiner* — George Wyszomierski
(74) *Attorney, Agent, or Firm* — Lex IP Meister, PLLC

(57) ABSTRACT

There are provided metallic glass matrix composites with controllable work-hardening capacity. In more detail, there are provided metallic glass matrix composite with controllable work-hardening capacity capable of having significantly excellent toughness due to a metastable second phase precipitated in-situ in a metallic glass matrix by polymorphic phase transformation during a solidification process without a separate synthetic process, and capable of controlling work-hardening capacity by measuring physical properties of a second phase and adjusting a volume fraction ($V_f$) of the second phase due to constant correlation between the physical properties (absorbed energy $E^t_a$, a phase transformation temperature $T_{Ms}$, or a hardness $H_{2nd}$) of a metastable B2 second phase precipated in the metallic glass matrix and the absorbed energy ($E^p_{a,V}$) by work-hardening per unit volume fraction of the second phase in the metallic glass matrix.

7 Claims, 12 Drawing Sheets

(56) References Cited

FOREIGN PATENT DOCUMENTS

| | | |
|---|---|---|
| KR | 10-0448152 | 9/2004 |
| KR | 10-0513584 | 9/2005 |
| KR | 10-0564260 | 3/2006 |
| KR | 10-0723162 | 5/2007 |
| KR | 10-0867290 | 10/2008 |
| KR | 10-1197581 | 10/2012 |
| KR | 10-2013-0110689 | 10/2013 |
| KR | 10-2014-0130388 | 11/2014 |
| KR | 10-2015-0077189 | 7/2015 |
| KR | 10-1608614 | 3/2016 |

OTHER PUBLICATIONS

Yin, E. et al., "Microstructure and mechanical properties of a spray-formed Ti-based matallic glass former alloy", Journal of Alloys and Compounds, vol. 512, pp. 241-245, available online Sep. 29, 2011.*

* cited by examiner

METALLIC GLASS COMPOSITES WITH CONTROLLABLE WORK-HARDENING CAPACITY

CROSS-REFERENCE TO RELATED APPLICATION

This application is a Continuation Application of U.S. patent application Ser. No. 15/287,693, which was filed on Oct. 6, 2016, which claims priority to and the benefit of Korean Patent Application No. 10-2015-0141240 filed in the Korean Intellectual Property Office on Oct. 7, 2015, the entire contents of which are incorporated herein by reference.

BACKGROUND OF THE INVENTION

(a) Field of the Invention

The present invention relates to metallic glass composites with controllable work-hardening capacity.

(b) Description of the Related Art

In order to improve toughness of a structural material, research into methods of introducing a second phase to prepare a composite has been conducted with respect to various materials and processes. Particularly, in a case of metallic glass having high strength and elasticity but having brittleness, research into a technology of improving elongation by preparing a metallic glass matrix composite into which ceramic, a crystalline metal, or the like, is introduced as a second phase has been variously conducted. However, in the case of introducing ceramic as the second phase, there is a limitation in improving elongation of the composite, and in the case of introducing a ductile crystalline metal as the second phase, there is a limitation in improving toughness of the composite due to a decrease in strength by post-yield work softening and an initial necking phenomenon.

A technology of improving mechanical properties with respective to a general crystalline alloy by preparing the composite as described above has been variously developed, but the technology has focused on improvement of strength or processability, and it was known that in order to improve toughness, alloy heat treatment, or improvement of a solidification method and an alloy design method is more effective than preparation of the composite. More specifically, a method of inserting a metal wire as a reinforcement material to significantly increase elongation in order to improve mechanical properties of a crystalline magnesium metal material has been disclosed in Korean Patent No. 10-0513584, but in this method, toughness was not largely improved due to a decrease in strength. In addition, a composite in which carbon and carbide are introduced as second phases into a titanium alloy was disclosed in Korean Patent No. 10-0867290. In this case, the carbide reacted with various additives such as silicon (Si), chromium (Cr), titanium (Ti), vanadium (V), tantalum (Ta), molybdenum (Mo), zirconium (Zr), boron (B), calcium (Ca), and the like, to exist in a titanium grain boundary, such that strength was significantly improved, but elongation tended to be decreased, such that toughness was not largely improved. In addition, a technology for a titanium/aluminum composite in which a ceramic reinforcement material is inserted has been disclosed in Korean Patent Nos. 10-0564260 and 10-1197581, but there were limitations in that an effect of improving strength was excellent, but toughness was not improved.

However, since in the case of metallic glass, although there is a tendency to occur brittle fracture, unlike the crystalline alloy, it is difficult to control mechanical properties of the metallic glass by heat treatment, the solidification method, and the alloy design method, a technology for improving mechanical properties, particularly, toughness, by preparing a composite has been more actively developed. A technology capable of having a composite structure formed by partial crystallization in a metallic glass in the case in which Fe based metallic glass contains one element selected from Cu, Co, Al, Ti, and Zr in a range of 1 to 5% to thereby apply a strip casting process, which may not be applied due to brittleness of metallic glass, has been disclosed in Korean Patent No. 10-0723162. However, in the Related Art Document, there was a limitation in that a quantitative value for improving mechanical properties of an alloy except for processability improvement was not disclosed. A technology of improving toughness by preparing a composite containing metallic glass and crystalline copper particles as a second phase using a powder sintering method has been disclosed in Korean Patent No. 10-0448152. However, as post-yield strength is decreased, it is impossible to implement high toughness. Therefore, in order to implement ultra-high toughness in the metallic glass, a method capable of implementing work-hardening capacity of increasing post-yield strength by designing a new composite structure and systemically controlling the work-hardening capacity has been required.

Recently, it was reported that as a material capable of being introduced into the metallic glass to implement work-hardening capacity and improving toughness, a CuZr B2 crystalline phase transformation alloy is suitable, but a specific technology for a work-hardening device and a method of improving toughness has not yet been developed. A phase transformation alloy (shape memory alloy or superelastic alloy) is a material capable of significantly improving toughness through martensitic transformation under specific temperature and stress conditions. The reason is that the phase transformation alloy causes a large strain hardening section after phase transformation by partially consuming energy applied from the outside at the time of phase transformation as phase transformation energy and preventing stress concentration through a plurality of shear bands formed by interactions with a metallic glass matrix, thereby having a deformation behavior similar to a work-hardening behavior of a crystalline material.

The above information disclosed in this Background section is only for enhancement of understanding of the background of the invention and therefore it may contain information that does not form the prior art that is already known in this country to a person of ordinary skill in the art.

SUMMARY OF THE INVENTION

An exemplary embodiment of the present invention provides a metallic glass matrix composite and a method for manufacturing the metallic glass matrix composite capable of systemically controlling work-hardening capacity thereof by controlling physical properties of a second phase and adjusting a volume fraction of a phase, while implementing post-yield work-hardening by allowing a metastable second phase of which phase transformation from an austenite B2 phase to a martensite phase may occur to be precipitated in-situ in a metallic glass matrix by polymorphic phase transformation during a solidification process without a separate synthetic process.

An exemplary embodiment of the present invention provides a metallic glass matrix composite and a method for manufacturing the metallic glass matrix composite capable of adjusting a volume fraction of a second phase in the composite through casting process control due to fixed correlation between physical properties (absorbed energy, a phase transformation temperature, and hardness) of a precipitated second phase and absorbed energy per unit volume fraction of the second phase to control work-hardening capacity.

Another embodiment of the present invention provides a metallic glass matrix composite and a method for manufacturing the metallic glass matrix composite capable of preventing brittle fracture of a metallic glass alloy matrix by decreasing concentration of stress applied to a material during a deformation process through phase transformation of a metastable second phase precipitated in the metallic glass matrix by polymorphic phase transformation during a solidification without a separate synthetic process into a stable phase, and capable of having a large strain hardening section after phase transformation to improve toughness through a work-hardening behavior.

In the metallic glass matrix composite according to the exemplary embodiment of the present invention, a crystalline metastable second phase formed through polymorphic phase transformation may be precipitated, such that work-hardening for improving toughness of metallic glass through phase transformation of the metastable second phase occurring at the time of deformation may be performed.

In addition, the metallic glass matrix composite according to the exemplary embodiment of the present invention may be a metallic glass matrix composite capable of systemically adjusting a precipitated phase-transformable metastable second phase to control work-hardening capacity, and may contain about 35 to 58 at % of Ti, about 35 to 50 at % of Cu, about 4.5 to 12 at % of Ni, and about 0.5 to 5 at % of Si, and further contain one or more elements selected from Zr, Hf, V, Nb, Ta, Nb, and Cr, which are early transition metals (ETM), and Al and Sn, which are post transition metals (PTM), in a range of about 1 to 15 at %.

In detail, the second phase formed by polymorphic phase transformation during the solidification may have a composition similar to that of the matrix as a metastable phase generally formed in a rapid cooling process, and has a tendency to be phase-transformed into a stable phase. Particularly, due to the tendency as described above, the crystalline metastable phase may serve as a phase transformation media of which a phase is transformed at the time of deformation of the material, and phase transformation of the crystalline metastable phase may serve as a mechanism relaxing stress applied to the material to inhibit concentration of the stress, thereby preventing brittle fracture of the metallic glass matrix.

The metallic glass matrix composite according to the exemplary embodiment of the present invention may be an alloy containing about 35 to 58 at % of Ti, about 35 to 50 at % of Cu, about 4.5 to 12 at % of Ni, and about 0.5 to 5 at % of Si so as to enable formation of the metastable second phase by polymorphic phase transformation while enabling metallic glass formation of a matrix metal by improving liquid-phase stability.

Further, one or more elements selected from Zr, Hf, V, Nb, Ta, Nb, and Cr, which are early transition metals (ETM), and Al and Sn, which are post transition metals (PTM) may be added to the metallic glass matrix composite in a range of about 1 to 15 at %.

Here, since Zr, Hf, V, Nb, Ta, Nb, and Cr, which are the early transition metals (ETM), and Al and Sn, which are the post transition metals (PTM) are elements improving glass forming ability at the time of being added to a quaternary alloy, a larger metallic glass matrix composite may be prepared by adding these elements, and characteristics of the metastable second phase precipitated by polymorphic phase transformation may be adjusted through multiple elements. However, in the case in which a content of the additionally added element is about 15 at % or more, another phase in addition to a phase-transformable B2 phase may be additionally multi-precipitated, which is not preferable.

Further, in the metallic glass matrix composite according to the exemplary embodiment of the present invention, since correlation between each of the properties of the phase-transformable metatable second phase and work-hardening capacity of the composite is fixed, work-hardening capacity of the composite may be controlled by finally measuring the physical properties (absorbed energy $E^t_a$, a phase transformation temperature $T_{Ms}$, or a hardness $H_{2nd}$) of the second phase in the metallic glass matrix to calculate absorbed energy by work-hardening per unit volume fraction of the second phase, and adjusting the volume fraction of the second phase in the composite through casting process control.

In detail, the absorbed energy (J/cm$^3$·vol %) by work-hardening per unit volume fraction of the phase-transformable metastable second phase (J/cm$^3$·vol %) may be calculated using the following Equation, and an effect caused by the volume fraction of the second phase may be excluded.

$$E^p_{a,V} = \left( \int_{\epsilon_y}^{\epsilon_f} (\sigma - \sigma_y) d\epsilon - \frac{(\sigma_f - \sigma_y)^2}{2e} \right) / V_f$$

($\varepsilon_y$: yield strain, $\varepsilon_f$: fracture strain, $\sigma_y$: yield stress, $\sigma_f$: fracture stress, and Vf: volume fraction of second phase in metallic glass matrix composite)

Absorbed energy by plastic deformation is a value corresponding to toughness at the time of performing a tension test, work-hardening ability may be quantitatively compared by reflecting work-hardening rate, an increase in elongation, an increase in strength, and a difference in elastic modulus between materials. Further, Correlation Equations between the physical properties ($E^t_a$, $T_{Ms}$, or $H_{2nd}$) of the phase-transformable metastable second phase and $E^p_{a,V}$ may be $E^p_{a,V}=A_0E^t_a-B_0$ ($A_0=5(\pm0.5)/10^3$, $B_0=6(\pm3)/10^2$), $E^p_{a,V}=C_0T_{Ms}-D_0$ ($C_0=2.6(\pm0.2)/10^3$, $D_0=1.6(\pm0.2)/10$), and $E^p_{a,V}=E_0H_{2nd}+F_0$ ($E_0=-5(\pm0.5)/10^3$, $F_0=2.7(\pm0.5)$), (unit: $E^p_{a,V}$(J/cm$^3$vol %), $H_{2nd}$(HV), $T_{Ms}$ (K), $E^t_a$(J/cm$^3$), respectively, these Correlation Equations may be fixed in the metastable second phase precipitated in a composition region according to the exemplary embodiment of the present invention. Therefore, in the case of measuring the physical properties ($E^t_a$, $T_{Ms}$, or $H_{2nd}$) of the phase-transformable metastable second phase according to the exemplary embodiment of the present invention, the absorbed energy by work-hardening per unit volume fracture of the second phase may be quantitatively calculated through these Correlation Equations. In addition, according to the exemplary embodiment of the present invention, in an alloy system in a boundary composition region in which a crystalline metastable phase and bulk metallic glass may be formed, the volume fraction of the phase-transformable second phase may be adjusted by adjusting a suction casting process condition.

The process conditions controlled according to the exemplary embodiment of the present invention may be three, that is, an output power of arc plasma, a gas pressure when a molten metal is injected into a mold, and a cooling capacity through the mold. More specifically, the output power of the arc plasma may be determined by adjusting an output voltage and an output current, and the higher the output power, the higher the volume fraction of the second phase. In addition, the higher the gas pressure, the lower the volume fraction of the second phase. Further, the cooling capacity may be changed depending on a diameter and a shape of the mold, water cooling, or the like, and the thicker the test sample prepared in the mold, the lower the cooling capacity and the higher the volume fraction of the second phase. Therefore, the metallic glass matrix composite with controllable work-hardening capacity may be prepared by adjusting the deduced $E^{q}_{a,V}$ value and the volume fraction of through the casting process control.

According to an embodiment of the present invention, the metallic glass matrix composite having a structure in which the metastable second phase is precipitated in the metallic glass matrix by polymorphic phase transformation may be provided without a separate additional process.

Further, the metallic glass matrix composite according to the present invention may prevent brittle fracture of the metallic glass matrix by stress relaxation and large strain hardening behavior accompanied when the metastable second phase precipitated by polymorphic phase transformation is transformed into the stable phase, thereby making it possible to significantly improve toughness.

A preparation method of the metallic glass matrix composite according to the present invention, which is a method capable of starting from a mother element metal, which is a raw material, to complete the alloying and production of the composite in a single process, may significantly decrease a cost and production time as compared to a multi-step composite preparation method using the existing metal power, which is complicated and requires a large cost.

Particularly, in the metallic glass matrix composite according to the exemplary embodiment of the present invention, Correlation Equation between the physical properties of the phase-transformable metastable second phase and work-hardening capacity of the composite may be fixed, such that the work-hardening of the metallic glass matrix composite may be easily controlled, and the related Equations may be utilized as a method for predicting and evaluating work-hardening capacity of the composite. More specifically, since Equations suggested according to the exemplary embodiment of the present invention includes only the absorbed energy $E^{t}_{a}$, the phase transformation temperature $T_{Ms}$, or the hardness $H_{2nd}$ as variables, these Equations may be utilized in main Equations and evaluation methods in computer simulations, and the like, for effectively controlling work-hardening capacity of the composite by controlling physical properties of the second phase. In addition, work-hardening capacity of the composite may be easily controlled by effectively adjusting the volume fraction for the phase-transformable metastable second phase in the metallic glass matrix in the alloy system in the boundary composition region in which the crystalline metastable phase and the bulk metallic glass may be formed. Therefore, work-hardening capacity of the composite may be predicted only by measuring the physical properties ($E^{t}_{a}$, $T_{Ms}$, or $H_{2nd}$) of the second phase of the prepared composite, and it is possible to prepare a metallic glass matrix composite with controllable work-hardening capacity, so as to have physical properties to be desired by using Correlation Equations between the physical properties of the phase-transformable metastable second phase and an increase in work-hardening capacity of the metallic glass matrix composite and casting process control.

DETAILED DESCRIPTION OF THE EMBODIMENTS

Figure 1:
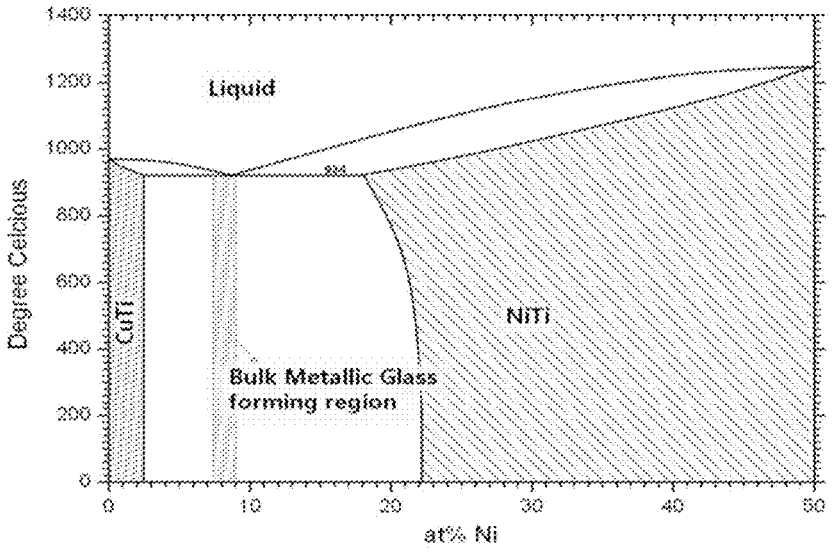
FIG. 1 is a pseudo-binary phase diagram of a Ti—Cu—Ni ternary alloy.

Hereinafter, exemplary embodiments of the present invention will be described in detail with reference to the accompanying drawings and Tables.

A metallic glass matrix composite according to the present exemplary embodiment is composed of a Ti—Cu—Ni—Si based metallic glass matrix and a metastable second phase precipated by polymorphic phase transformation.

The second phase formed by polymorphic phase transformation during a solidification process, which is a metastable phase having a composition similar to a matrix composition, tends to be changed to a stable phase by an external temperature or stress. Due to characteristics of the metatable phase, the metastable phase serves as a phase transformation media at the time of deformation of a material, phase transformation of a crystalline metastable phase as described above serves as a mechanism of relaxing stress applied to the material, thereby preventing brittle fracture of the metallic glass matrix.

Therefore, the present inventors developed a metallic glass composite having excellent strength and toughness due to work-hardening characteristics obtained by precipitating a phase-transformable crystalline metastable second phase by stress in a high-strength Ti based metallic glass matrix through polymorphic phase transformation of a matrix metal caused by metal solidification.

To this end, glass forming ability (GFA) should be high, a metastable second phase should be precipitated through polymorphic phase transformation of a matrix metal at the time of solidification, and phase transformation of the precipitated second phase to a stable phase should easily occur.

Ti is a main element of a Ti based metallic glass material having excellent mechanical properties, and has high liquid-phase stability as a deep eutectic composition in the case of being alloyed with Cu and Ni, thereby having excellent glass forming ability. In addition, a TiCu(Ni) metastable phase, which is a main phase according to an exemplary embodiment of the present invention, tends to be precipitated as a metastable phase through polymorphic phase transformation during solidification.

In consideration of the facts as described above, a ternary eutectic composition represented by Composition Formula, $Ti_{50}Cu_{42}Ni_8$ may be determined as a base composition by evaluating glass forming ability in various compositions with respect to ternary alloys composed of Ti, Cu, and Ni. In an alloy system composed of Ti, Ni, and Cu, a size difference between Ti (0.147 nm), which is a main element, and Cu(0.128 nm), and a size difference between Ti and Ni(0.124 nm) were about 13% and about 16%, respectively, there are large differences in atom size, and heat of mixing of Ti—Cu and Ti—Ni are about −67 kJ/mol·atom and about −140 kJ/mol·atoms, respectively, which are large negative values, such that the alloy system is consistent with heuristics, and the $Ti_{50}Cu_{42}Ni_8$ composition, which is a composition similar to an eutectic composition, has excellent glass forming ability due to excellent liquid-phase stability. Therefore, even though the $Ti_{50}Cu_{42}Ni_8$ composition is a ternary alloy, the $Ti_{50}Cu_{42}Ni_8$ composition has excellent glass forming ability, and as a result, the $Ti_{50}Cu_{42}Ni_8$ composition has a bulk metallic glass formation maximum diameter of about 2 mm.

FIG. 1 is a pseudo-binary phase diagram of a Ti—Cu—Ni ternary alloy. As described above, a $Ti_{50}Cu_{42}Ni_8$ alloy composition, which is a composition forming a ternary eutectic reaction, is an alloy composition having excellent glass forming ability based on excellent liquid-phase stability.

Figure 2:
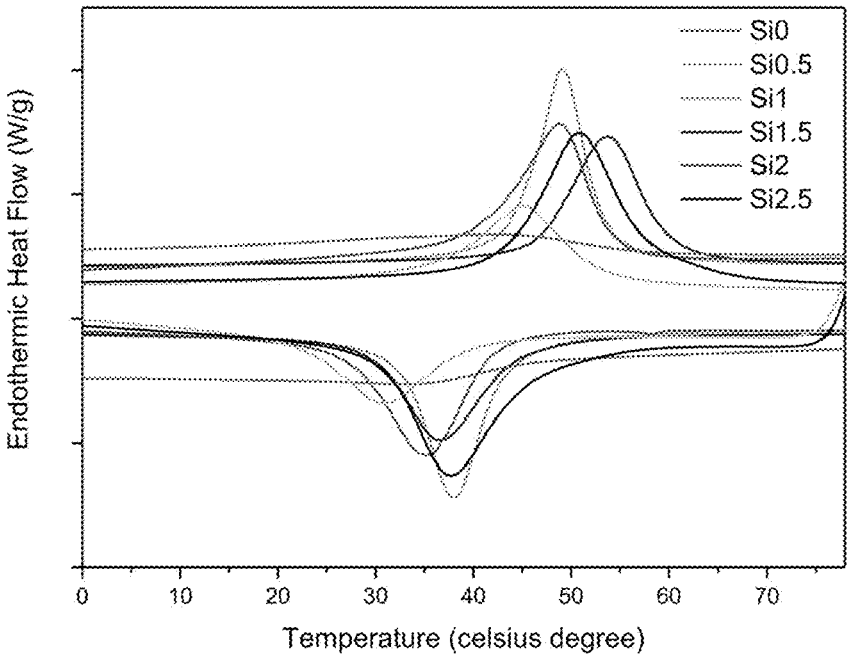
FIG. 2 is a differential scanning calorimetry result illustrating an effect of adding Si to the Ti—Cu—Ni alloy.

FIG. 2 is a differential scanning calorimetry result illustrating an effect of adding Si to the Ti—Cu—Ni alloy. Glass forming ability is excellent in a $Ti_{50}Cu_{42}Ni_8$ ternary alloy composition region, but it is impossible to precipitate a single metastable second phase by polymorphic phase transformation through polymorphic precipitation during a solidification process. However, as illustrated in FIG. 2, it may be confirmed that as a small amount of Si is added to the alloy composition region, a stable region of a phase-transformable metastable B2 phase is expanded, such that the B2 phase may be precipitated alone by polymorphic phase transformation during solidification.

Therefore, the present inventors developed an alloy composition which has excellent glass forming ability and in which a metal stable B2 second phase may be precipitated by polymorphic phase transformation by adding Si at a content of about 0.5 at % or more based on the $Ti_{50}Cu_{42}Ni_8$ alloy composition. Here, in the case in which the content of added Si is more than 5 at %, glass forming ability is rapidly deteriorated, such that it become difficult to prepare a composite even by adjusting a cooling rate. Results obtained by confirming glass forming ability and precipitated second phase of various alloy compositions according to an exemplary embodiment of the present invention are illustrated in the following Table 1.

TABLE 1

| Ti—Cu—Ni—X | | Test Sample | |
|---|---|---|---|
| | | | Crystalline phase |
| System | Composition | 2 mm 3 mm 5 mm (C) | |
| TiCuNi | $Ti_{42}Cu_{50}Ni_8$ | C | multi-phases |
| | $Ti_{46}Cu_{46}Ni_8$ | C | multi-phases |
| | $Ti_{48}Cu_{42}Ni_{10}$ | C | multi-phases |
| | $Ti_{50}Cu_{40}Ni_{10}$ | a + C | multi-phases |
| | $Ti_{50}Cu_{42}Ni_8$ | A + C | multi-phases |
| | $Ti_{50}Cu_{44}Ni_6$ | a + C | multi-phases |
| | $Ti_{55}Cu_{37}Ni_8$ | C | multi-phases |
| | $Ti_{62}Cu_{30}Ni_8$ | C | multi-phases |

TABLE 1-continued

| Ti—Cu—Ni—X | | Test Sample | | | |
|---|---|---|---|---|---|
| | | | | | Crystalline phase |
| System | Composition | 2 mm | 3 mm | 5 mm (C) | |
| TiCuNiZr | $Ti_{45}Cu_{43}Ni_7Zr_5$ | A | a + C | | multi-phases |
| | $Ti_{44}Cu_{42}Ni_7Zr_7$ | A | a + C | | multi-phases |
| | $Ti_{43}Cu_{41}Ni_7Zr_9$ | A | A + c | | multi-phases |
| TiCuNiSi | $Ti_{49.5}Cu_{42}Ni_8Si_{0.5}$ | a + C | | | single B2 |
| | $Ti_{49}Cu_{42}Ni_8Si_1$ | A + c | | | single B2 |
| | $Ti_{48}Cu_{41}Ni_8Si_3$ | A + c | | | single B2 |
| | $Ti_{47}Cu_{41}Ni_7Si_5$ | a + C | | | single B2 |
| | $Ti_{48}Cu_{40}Ni_5Si_7$ | C | | | multi-phase |
| | $Ti_{48}Cu_{45}Ni_2Si_5$ | C | | | multi-phase |
| TiCuNiSiSn | $Ti_{52}Cu_{38}Ni_7Si_1Sn_2$ | a + C | | | single B2 |
| | $Ti_{51}Cu_{39}Ni_7Si_1Sn_2$ | a + C | | | single B2 |
| | $Ti_{50}Cu_{40}Ni_7Si_1Sn_2$ | a + C | | | single B2 |
| | $Ti_{49}Cu_{41}Ni_7Si_1Sn_2$ | a + C | | | single B2 |
| | $Ti_{48}Cu_{42}Ni_7Si_1Sn_2$ | a + C | | | single B2 |
| | $Ti_{47}Cu_{43}Ni_7Si_1Sn_2$ | a + C | | | single B2 |
| | $Ti_{46}Cu_{44}Ni_7Si_1Sn_2$ | a + C | | | single B2 |
| | $Ti_{45}Cu_{45}Ni_7Si_1Sn_2$ | a + C | | | single B2 |
| | $Ti_{44}Cu_{46}Ni_7Si_1Sn_2$ | a + C | | | single B2 |
| TiCuNiSiSn(Al)Zr | $Ti_{48}Cu_{40}Ni_7Si_1Sn_2Zr_2$ | A | A + c | | single B2 |
| | $Ti_{45}Cu_{43}Ni_7Si_1Sn_2Zr_2$ | A | a + c | | single B2 |
| | $Ti_{43}Cu_{45}Ni_7Si_1Sn_2Zr_2$ | A | A + c | | single B2 |
| | $Ti_{42}Cu_{43}Ni_7Si_1Sn_2Zr_5$ | A | A + c | | single B2 |
| | $Ti_{41}Cu_{44}Ni_7Si_1Sn_1Al_1Zr_5$ | A | A + c | | single B2 |
| | $Ti_{40}Cu_{45}Ni_7Si_1Sn_2Zr_5$ | A | A | a + C | single B2 |
| | $Ti_{45}Cu_{38}Ni_7Si_1Sn_2Zr_7$ | A | A + c | | single B2 |
| | $Ti_{44}Cu_{39}Ni_7Si_1Sn_1Al_1Zr_7$ | A | A + c | | single B2 |
| | $Ti_{43}Cu_{40}Ni_7Si_1Sn_2Zr_7$ | A | A + c | | single B2 |
| | $Ti_{42}Cu_{41}Ni_7Si_1Sn_1Al_1Zr_7$ | A | A | a + C | single B2 |
| | $Ti_{42}Cu_{41}Ni_7Si_1Sn_2Zr_7$ | A | A | a + C | single B2 |
| | $Ti_{39}Cu_{38}Ni_7Si_4Sn_5Zr_7$ | a + C | | | multi-phase |
| TiCuNiSiSnZr(Cr, | $Ti_{44}Cu_{37}Ni_7Si_1Sn_2Zr_7Cr_2$ | A + c | | | single B2 |
| V, | $Ti_{44}Cu_{37}Ni_7Si_1Sn_2Zr_7V_2$ | A + c | | | single B2 |
| Hf, Ta, Nb) | $Ti_{44}Cu_{37}Ni_7Si_1Sn_2Zr_7Hf_2$ | A | A + c | | single B2 |
| | $Ti_{44}Cu_{37}Ni_7Si_1Sn_2Zr_7Ta_2$ | A | A + c | | single B2 |
| | $Ti_{43}Cu_{38}Ni_7Si_1Sn_2Zr_7Nb_2$ | A | A | A + c | single B2 |
| | $Ti_{42}Cu_{37}Ni_7Si_1Sn_2Zr_7Nb_4$ | A | A + c | A + c | single B2 |
| | $Ti_{40}Cu_{35}Ni_7Si_1Sn_2Zr_9Nb_6$ | a + C | | | multi-phase |
| | $Ti_{39}Cu_{34}Ni_7Si_1Sn_2Zr_9Nb_8$ | C | | | multi-phase |

In Table 1, A and a indicate a metallic glass phase, wherein A indicates a metallic glass phase of which a volume fraction is large and a indicates a metallic glass phase of which a volume fraction is small, and C and c indicate crystalline phase, wherein C indicates a crystalline phase of which a volume fraction is large and c indicates a crystalline phase of which a volume fraction is small. As illustrated in Table 1, it may be appreciated that in the cases of test sample in which addition elements are added based on a TiCuANi based alloy, a composite in which the metallic glass phase and the crystalline phase are mixed is formed in the vicinity of a maximum size at which the metallic glass phase may be formed. Particularly, it may be confirmed that in the case of adding Si in a range of about 0.5 to 5 at %, a single metastable B2 phase is precipitated, and in the case in which one or more elements selected from Zr, Hf, V, Nb, Ta, and Cr, which are early transition metals (ETM), and Al and Si, which are post transition metals (PTM) is additionally added in a range of about 1 to 15 at %, the single metastable B2 phase may also be precipitated in the metallic glass matrix through polymorphic phase transformation. However, in the case in which a content of the additionally added element is about 15 at % or more, another phase may be polymorphically precipitated in addition to the B2 phase by phase transformation, which is not preferable.

Features of a metallic glass matrix composite in which crystalline metastable second phase is precipitated through polymorphic phase transformation during the solidification process in Ti—Cu—Ni—Si based alloy prepared by rapid solidification within the above-mentioned composition range were analyzed as follows.

Figure 3:
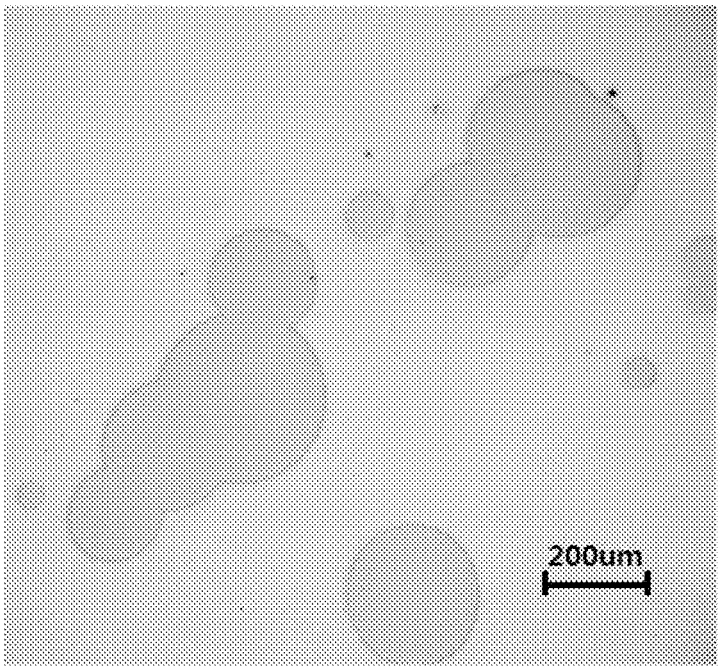
FIG. 3 is a scanning electron microscope (SEM) photograph of a test sample prepared according to an exemplary embodiment of the present invention and a graph illustrating X-ray diffraction analysis result thereof.
Figure 3:
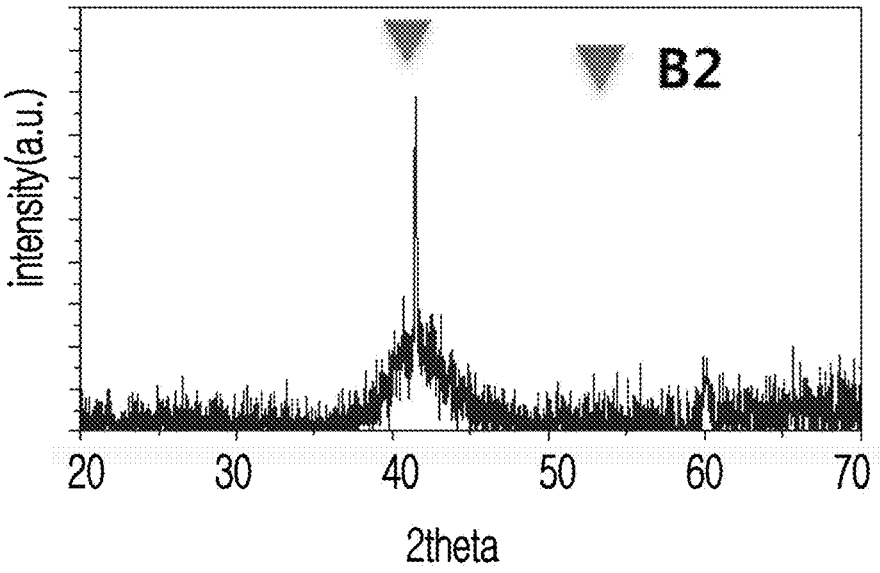

FIG. 3 is a scanning electron microscope (SEM) photograph of a test sample prepared according to an exemplary embodiment of the present invention and a graph illustrating X-ray diffraction analysis result thereof. The test sample has a $Ti_{48}Cu_{40}Ni_7Si_1Sn_2Zr_2$ composition, and it may be confirmed that the test the test sample is composed of a matrix portion having a light color and a precipitation portion having a dark color in the SEM photograph. It may be appreciated from the accompanying X-ray diffraction analysis result that the matrix portion is a metallic glass phase, and the precipitation portion, which is a crystalline phase, is a metastable B2 second phase formed through polymorphic phase transformation during the solidification process.

Figure 4:
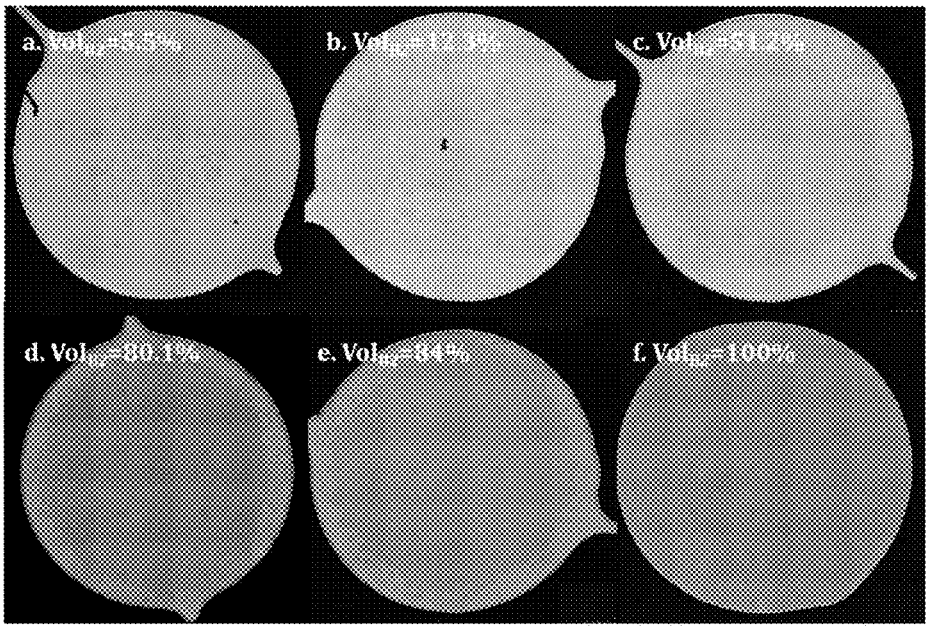
FIG. 4 is a result obtained by observing cross-sectional micro-structure of metallic glass matrix composites having various volume fractions of a second phase, prepared by adjusting an arc plasma current in a $Ti_{48}Cu_{40}Ni_7Si_1Sn_2Zr_2$ alloy composition according to an exemplary embodiment of the present invention using an optical microscope.

FIG. 4 is an optical microscope photograph illustrating cross sections of metallic glass matrix composites having various volume fractions of a second phase, prepared using a $Ti_{48}Cu_{40}Ni_7Si_1Sn_2Zr_2$ composition among alloys according to an exemplary embodiment of the present invention. In the case of preparing a metallic glass matrix composite by process control with respect to the same composition, a metastable B2 second phase of which absorbed energy ($E^t_a$) and $T_{Ms}$ were the same as each other was precipitated. In detail, in the case of adjusting an intensity of an output current to about 50, 100, 150, 200, and 250 A under the condition that an output voltage of an arc plasma melting device is about 30 V, composite having metastable B2 second phase (dark region) having volume fractions of about 5.5 Vol %, about 12.3 Vol %, about 51.2 Vol %, about 80.1 Vol %, and about 84 Vol % in the $Ti_{48}Cu_{40}Ni_7Si_1Sn_2Zr_2$ composition, respectively, and metallic glass matrix (bright region) having the residual volume fractions, respectively, were prepared. The reason may be that a melting temperature and flowability of a molten metal are changed depending on the output power (output voltage: about 5 to 50 V, output current; about 30 to 300 A), and thus, a supercooling degree at the time of solidification is changed, which affects formation of the metastable B2 second phase formed by allotropic transformation in the metallic glass matrix. Here, in the case in which the output power is excessively low (the output voltage is less than about 5 V or the output current is less than about 30 A), it may be difficult to completely melt a material, and in the case in which output power is excessively high (the output voltage is more than about 50 V or the output current is more than about 300 A), a change in composition may occur due to vaporization of a constitution element in the material. Further, in the case in which an injection pressure of the molten metal into a copper mold at the time of casting is adjusted (about 0 to 600 torr), there is a difference in cooling capacity due to a change in flowability in the mold, such that it is possible to control the volume fraction of the second phase depending on the difference in crystallinity. In the case in which the casting is performed at a low pressure of about 10 torr based on a current amount of about 100 A, it is possible to obtain a second phase with a high volume fraction of about 90 vol %, and in the case in which the casting is performed at a high pressure of about 400 torr, it is possible to a second phase with a low volume fraction of about 10 vol %. Here, in the case in which the injection pressure is excessively high (more than about 600 torr), air bubbles are injected due to a turbulence phenomenon in the molten metal, voids may be excessively formed in the test sample, which Is not preferable in view of preparing a suitable test sample. In addition, a cooling rate condition having a large influence on glass forming ability of the alloy may also have a significant influence on controlling the volume fraction of the composite, and in the case of the alloy composition according to the present invention, it is preferable to perform the casting while adjusting cooling capacity in a range of about $10^1$-$10^4$ K/s in consideration of glass forming ability.

Figure 5:
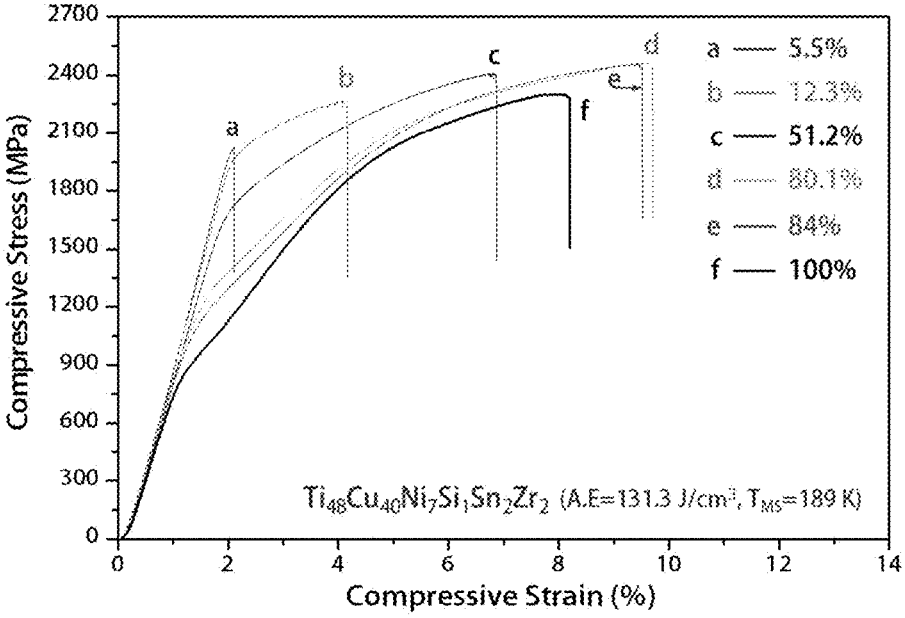
FIG. 5 illustrates a stress-strain diagram obtained by performing a uniaxial compression test on the metallic glass matrix composites having various volume fractions of the second phase, illustrated in FIG. 4.

FIG. 5 illustrates a stress-strain diagram obtained by performing a uniaxial compression test on the metallic glass matrix composites illustrated in FIG. 4. In the case in which a volume fraction of a phase-transformable metastable B2 second phase is low (about 5.5 vol %), the metallic glass matrix composite has mechanical properties similar to those of metallic glass having brittleness, there is almost no work-hardening capacity, but as the volume fraction of the second phase, the work-hardening capacity of the composite is increased with a constant tendency. Therefore, it may be appreciated that in the case of adjusting a suction casting process condition to control the volume faction of the second phase while confirming contribution to a change in absorbed energy by work-hardening per unit volume fraction of the related second phase, it is possible to control work-hardening capacity of the metallic glass matrix composite.

Figure 6:
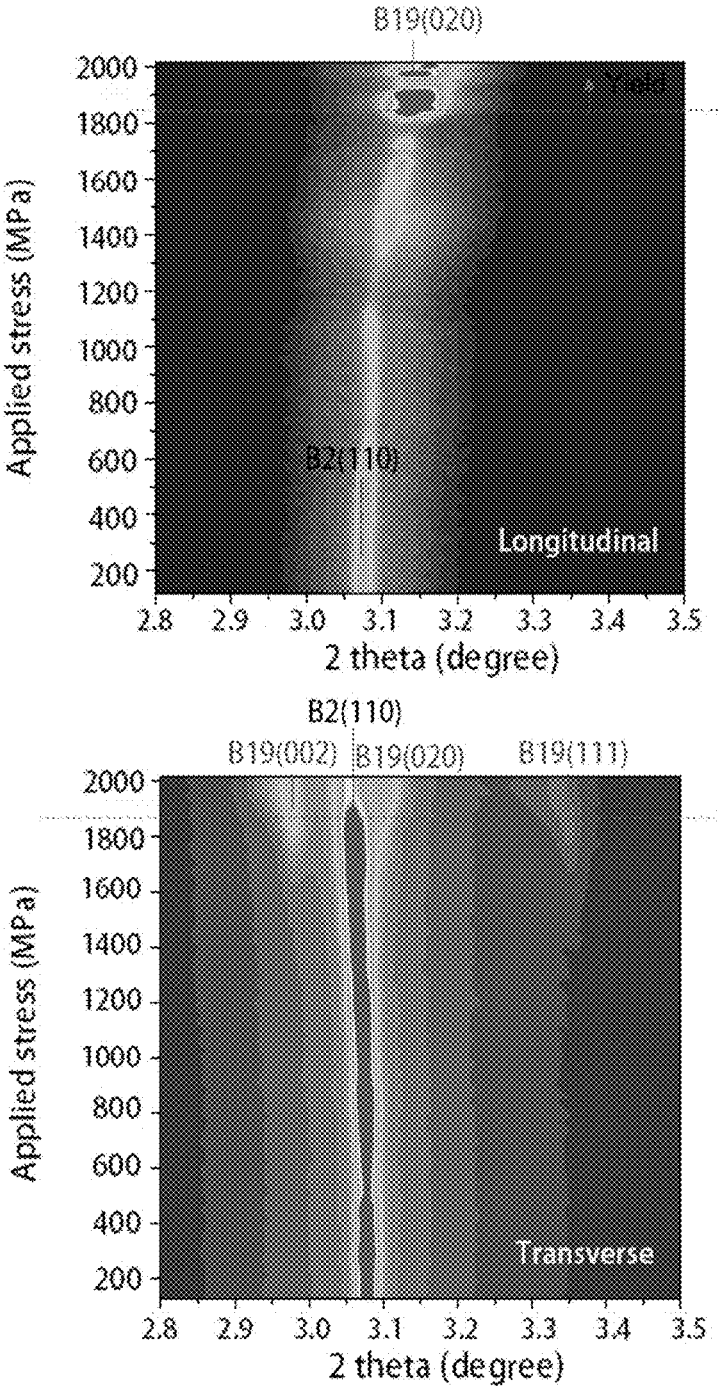
FIG. 6 is a high-energy X-ray diffraction analysis result illustrating a real-time phase transformation behavior at the time of compressing a test sample prepared using an alloy composite according to an exemplary embodiment of the present invention.

FIG. 6 is a high-energy X-ray diffraction analysis result illustrating a real-time phase transformation behavior at the time of compressing a composite test sample prepared using the $Ti_{48}Cu_{40}Ni_7Si_1Sn_2Zr_2$ alloy composition. Generally, in the case of structure analysis using high-energy X-ray, it is easy to observe phase transformation in a bulk type test sample due to high permeability, and a phase transformation behavior of about 3 mm bulk test sample prepared according to the present exemplary embodiment at the time of compression was real-time analyzed using the characteristics as described above. As an analysis result, it may be clearly confirmed that in the second phase existing as the B2 phase before applying stress thereto, phase transformation to a martensite phase occurred under a compression stress of about 1900 MPa (in the vicinity of a yield point of the material). This is clearly observed in both a vertical direction (left) and a horizontal direction (right) of the high-energy X-ray beam.

Figure 7:
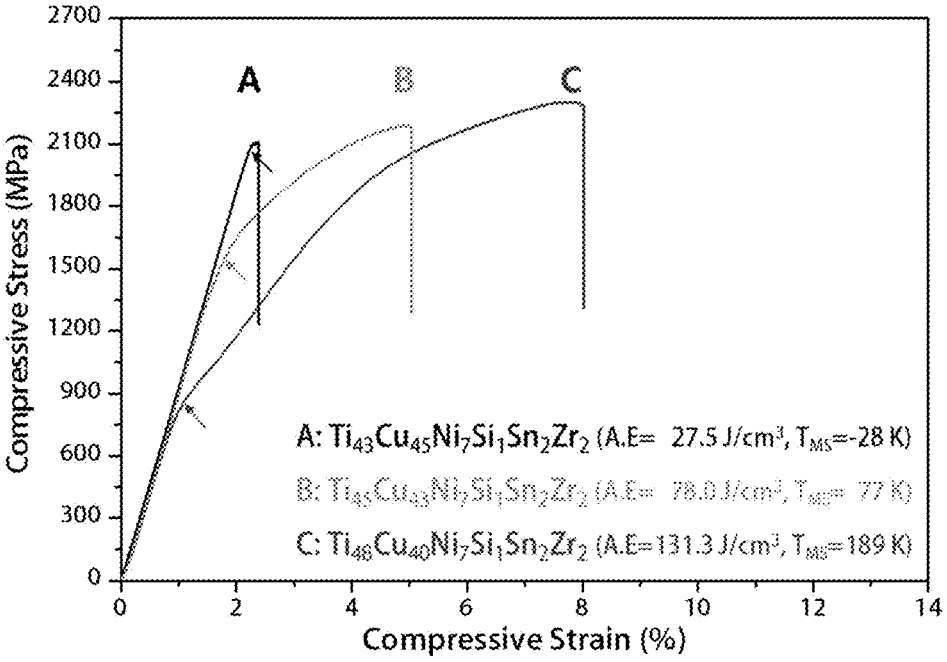
FIG. 7 illustrates a stress-strain diagram obtained by performing a compression test on phase-transformable metastable crystalline alloys, $Ti_{51-x}Cu_{37+x}Ni_7Si_1Sn_2Zr_2$ (x=3, 6, and 8 at %) according to an exemplary embodiment of the present invention.

FIG. 7 illustrates a stress-strain diagram obtained by performing a compression test on phase-transformable metastable B2 crystalline alloys, $Ti_{51-x}Cu_{37+x}Ni_7Si_1Sn_2Zr_2$ (x=3, 6, and 8 at %). As illustrated in FIG. 7, it may be appreciated that in the case of adjusting contents of Ti and Ca, absorbed energy may be controlled from A=about 131.3 J/cm$^3$ to B=about 78.0 J/cm$^3$ and C=about 27.5 J/cm$^3$, and yield stress (first yield by stress induced phase transformation) was also significantly decreased as illustrated in FIG. 7. The difference as described above is caused by a difference in properties of the formed metastable B2 phase, which may be confirmed from the fact that martensite-star temperatures ($T_{Ms}$) were different from each other (A=about 189 K, B=about 77 K, and C=about −28 K (estimated values by fitting result values)).

Figure 8:
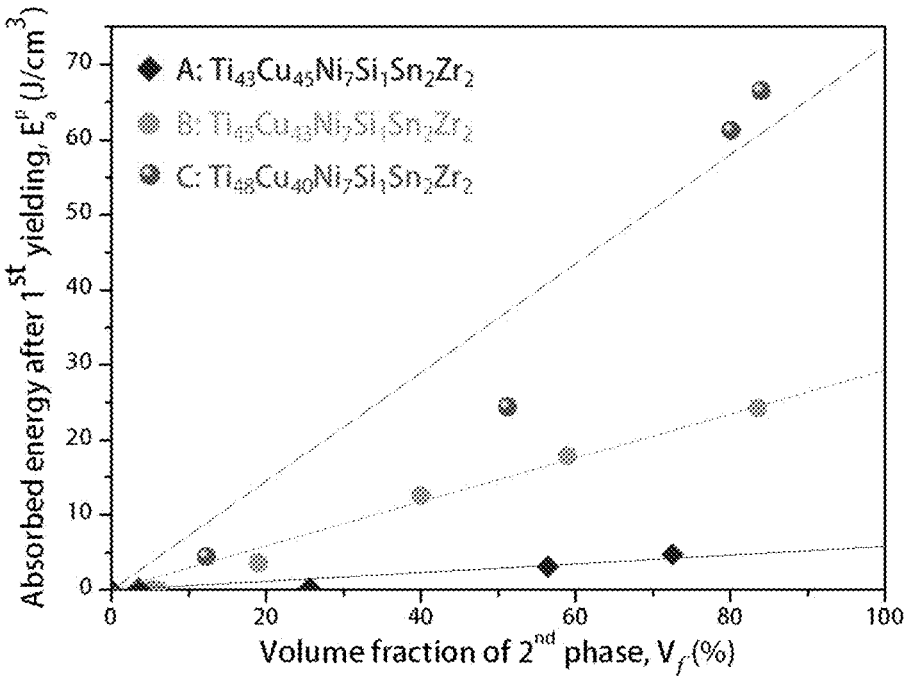
FIG. 8 is a graph illustrating a correlation between a volume fraction of a second phase of a metallic glass matrix composite prepared by process control in $Ti_{51-x}Cu_{37+x}Ni_7Si_1Sn_2Zr_2$ alloy compositions (x=3, 6, and 8 at %) according to an exemplary embodiment of the present invention and a change in absorbed energy ($E^{p}_{a}$) by work-hardening.

FIG. 8 is a graph illustrating a correlation between a change in absorbed energy ($E^p_a$) by work-hardening and a volume fraction of a second phase of metallic glass matrix composites prepared by process control in $Ti_{51-x}Cu_{37+x}Ni_7Si_1Sn_2Zr_2$ alloy compositions (x=3, 6, and 8 at %). In detail, absorbed energy obtained by deformation (work-hardening) after first yielding of the metallic glass matrix composite containing the phase-transformable metastable B2 phase is calculated using Equation $$E^p_{a,V} = \left( \int_{\epsilon_y}^{\epsilon_f} (\sigma - \sigma_y) d\epsilon - \frac{(\sigma_f - \sigma_y)^2}{2e} \right) / V_f$$

($\varepsilon_y$: yield strain, $\varepsilon_f$: fracture strain, $\sigma_y$: yield stress, $\sigma_f$: fracture stress, M: elastic modulus), and a change in absorbed energy by work-hardening depending on the volume fraction of the second phase in each of the composition is illustrated in FIG. 8. As illustrated in FIG. 8, as the volume fraction ($V_f$) of the phase-transformable metastable B2 second phase is increased, or the martensite-start temperature ($T_{Ms}$) of the second phase is increased, the absorbed energy by work-hardening is relatively increased, and as a gradient of a linear fitting function of data obtained using Equation is increased, the volume of the phase-transformable second phase is increased, and thus, a work-hardening capacity increase rate of the composite prepared using the corresponding composition is increased.

Figure 9:
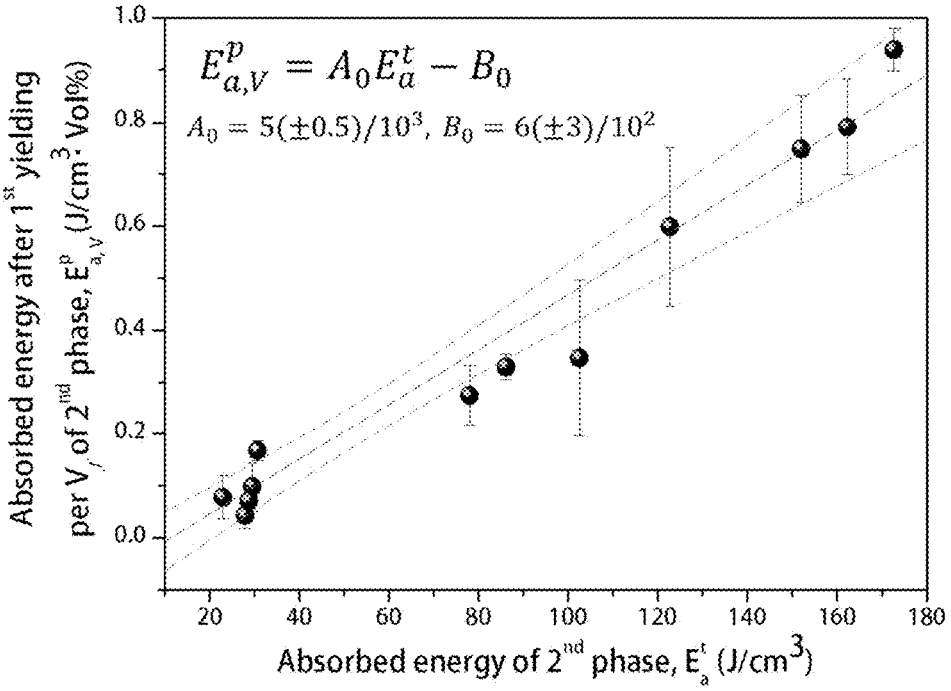
FIG. 9 is a graph illustrating a correlation between absorbed energy ($E^{t}_{a}$) of metastable crystalline alloys in $Ti_{51-x}Cu_{37+x}Ni_7Si_1Sn_2Zr_2$ alloy compositions (x=3, 6, and 8 at %) and $Ti_{53-x}Cu_{37+x}Ni_7Si_1Sn_2$ alloy compositions (x=1, 2, 3, 4, 5, 6, 7, 8, and 9 at %) according to the exemplary embodiment of the present invention, and absorbed energy ($E^{p}_{a,V}$) by work-hardening per unit volume fraction of a second phase formed in a metallic glass matrix composite prepared using each of the compositions.

FIG. 9 is a graph illustrating a correlation between absorbed energy ($E^t_a$) of metastable B2 crystalline alloys in $Ti_{51-x}Cu_{37+x}Ni_7Si_1Sn_2Zr_2$ alloy compositions (x=3, 6, and 8 at %) and $Ti_{53-x}Cu_{37+x}Ni_7Si_1Sn_2$ alloy compositions (x=1, 2, 3, 4, 5, 6, 7, 8, and 9 at %), and absorbed energy ($E^p_{a,V}$) by work-hardening per unit volume fraction of a second phase formed in a metallic glass matrix composite prepared using each of the compositions. Here, the absorbed energy of the phase-transformable B2 second phase is obtained by integrating the stress-strain diagram obtained by performing a compression test on an alloy prepared as a single B2 crystalline phase. According to FIG. 9, as the absorbed energy of the phase-transformable B2 second phase is increased, absorbed energy of the composite containing a second phase thereof by work-hardening is increased, and thus, plastic deformability is large. Correlation Equation therebetween is as follows: $E^p_{a,V}=A_0E^t_a-B_0(A_0=5\pm0.5/10^3, B_0=6\pm3/10^2)$. Work-hardening capacity of the composite may be controlled by measuring the absorbed energy ($E^t_a$), which is one of the physical properties, of the phase-transformable metastable B2 second phase precipitated in the composite to calculate absorbed energy ($E^p_{a,V}$) by work-hardening per unit volume fraction of the second phase formed in the metallic glass matrix composite prepared using each of the compositions.

Figure 10:
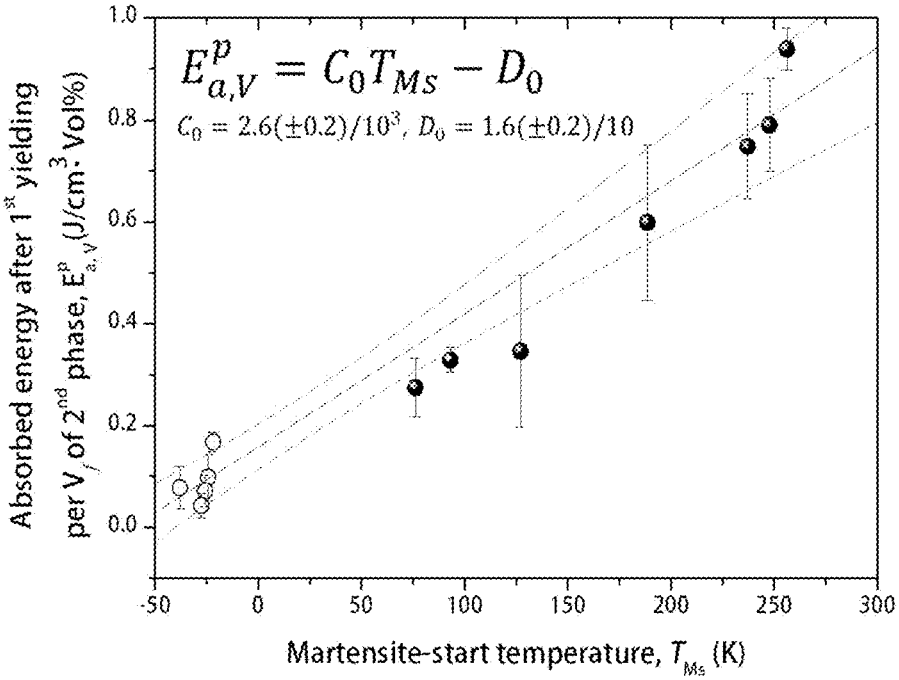
FIG. 10 is a graph illustrating a correlation between a martensite-start temperature ($T_{Ms}$) of a phase-transformable metastable second phase in composites prepared using $Ti_{51-x}Cu_{37+x}Ni_7Si_1Sn_2Zr_2$ alloy compositions (x=3, 6, and 8 at %) and $Ti_{53-x}Cu_{37+x}Ni_7Si_1Sn_2$ alloy compositions (x=1, 2, 3, 4, 5, 6, 7, 8, and 9 at %) according to the exemplary embodiment of the present invention and absorbed energy ($E^{p}_{a,V}$) by work-hardening per unit volume fraction of the second phase.

FIG. 10 is a graph illustrating a correlation between a martensite-start temperature ($T_{Ms}$) of a phase-transformable metastable second phase in composites prepared using $Ti_{51-x}Cu_{37+x}Ni_7Si_1Sn_2Zr_2$ alloy compositions (x=3, 6, and 8 at %) and $Ti_{53-x}Cu_{37+x}Ni_7Si_1Sn_2$ alloy compositions (x=1, 2, 3, 4, 5, 6, 7, 8, and 9 at %) and absorbed energy ($E^p_{a,V}$) by work-hardening per unit volume fraction of the second phase. In the case of the composition according to the exemplary embodiment, since the martensite-start temperature was in a measurement temperature range of a generally used measurement apparatus, a phase transformation temperature value was estimated by extrapolation using Correlation Equation between the absorbed energy of the metastable B2 second phase and the martensite-start temperature, and in order to distinguish the estimated value from a measured value, the estimated value was indicated by a circle in FIG. 10. According to FIG. 10, as the martensite-start temperature is increased, the absorbed energy of the composite by work-hardening is increased. Therefore, plastic deformability is increased, and Correlation Equation therebetween is as follows: $E^p_{a,V}=C_0T_{Ms}-D_0(C_0=\text{about } 2.6\pm0.2/10^3, D_0=\text{about } 1.6\pm0.2/10)$. Work-hardening capacity of the composite may be controlled by measuring the martensite-start temperature ($T_{Ms}$), which is one of the physical properties, of the phase-transformable metastable B2 second phase precipitated in the composite to calculate the absorbed energy ($E^p_{a,V}$) by work-hardening per unit volume fraction of the second phase formed in the metallic glass matrix composite prepared using each of the compositions.

Figure 11:
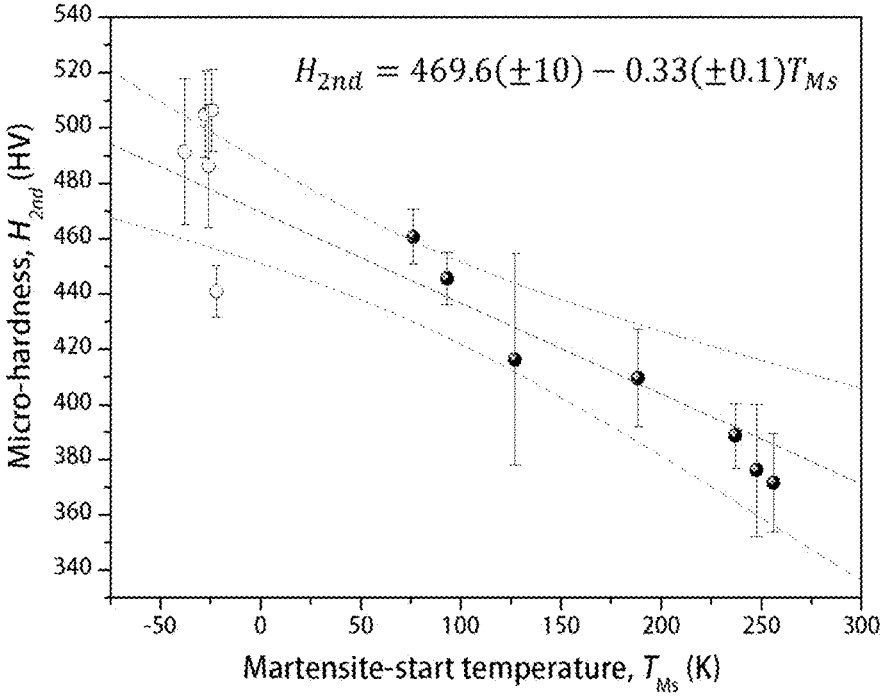
FIG. 11 a graph illustrating a correlation between a hardness ($H_{2nd}$) of the second phase in the composites prepared using the $Ti_{51-x}Cu_{37+x}Ni_7Si_1Sn_2Zr_2$ alloy compositions (x=3, 6, and 8 at %) and the $Ti_{53-x}Cu_{37+x}Ni_7Si_1Sn_2$ alloy compositions (x=1, 2, 3, 4, 5, 6, 7, 8, and 9 at %) according to the exemplary embodiment of the present invention and the martensite-start temperature ($T_{Ms}$).

FIG. 11 a graph illustrating a correlation between a hardness ($H_{2nd}$) of the second phase in the composites prepared using the $Ti_{51-x}Cu_{37+x}Ni_7Si_1Sn_2Zr_2$ alloy compositions (x=3, 6, and 8 at %) and the $Ti_{53-x}Cu_{37+x}Ni_7Si_1Sn_2$ alloy compositions (x=1, 2, 3, 4, 5, 6, 7, 8, and 9 at %) and the martensite-start temperature ($T_{Ms}$). According to FIG. 11, $T_{Ms}$ of the phase-transformable metastable B2 second phase may be replaced with and represented by the hardness, which is one of the physical properties, of the second phase in the composite using Correlation Equation between $T_{Ms}$ and $H_{2nd}$, in other words, $H_{2nd}=\text{about } 469.6\pm10-0.33\pm0.1$.

Figure 12:
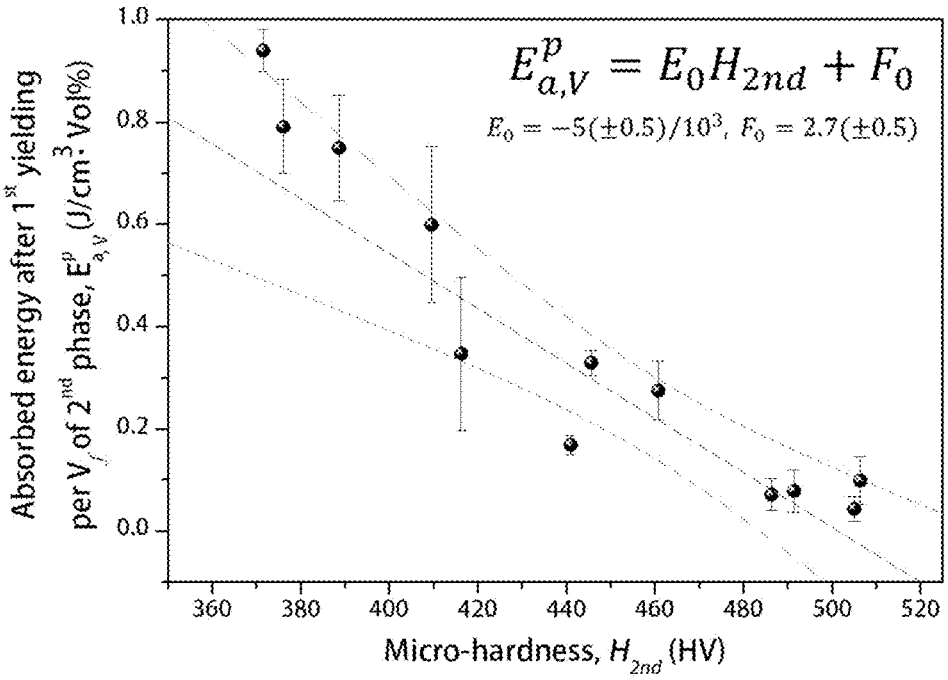
FIG. 12 is a graph illustrating a correlation between absorbed energy ($E^{p}_{a,v}$) by work-hardening per unit volume fraction of the second phase in the metallic glass matrix composite prepared using $Ti_{51-x}Cu_{37+x}Ni_7Si_1Sn_2Zr_2$ alloy compositions (x=3, 6, and 8 at %) and $Ti_{53-x}Cu_{37+x}Ni_7Si_1Sn_2$ alloy compositions (x=1, 2, 3, 4, 5, 6, 7, 8, and 9 at %) according to the exemplary embodiment of the present invention and the hardness ($H_{2nd}$) of the second phase.

FIG. 12 is a graph illustrating a correlation between absorbed energy ($E^p_{a,V}$) by work-hardening per unit volume fraction of the second phase in the metallic glass matrix composite prepared using $Ti_{51-x}Cu_{37+x}Ni_7Si_1Sn_2Zr_2$ alloy compositions (x=3, 6, and 8 at %) and $Ti_{53-x}Cu_{37+x}Ni_7Si_1Sn_2$ alloy compositions (x=1, 2, 3, 4, 5, 6, 7, 8, and 9 at %) and the hardness ($H_{2nd}$) of the second phase. According to FIG. 12, as a hardness value of the phase-transformable metastable B2 second phase is decreased, the absorbed energy of the composite containing the B2 phase as a second phase by work-hardening is increased, and thus plastic deformability is increased. Correlation Equation therebetween is as follows: $E^p_{a,V}=E_0H_{2nd}+F_0(E_0=\text{about } -5\pm0.5/10^3, F_0=\text{about } 2.7\pm0.5)$. Work-hardening capacity of the composite may be controlled by measuring hardness, which is one of the physical properties, of the phase-transformable metastable B2 second phase precipitated in the composite and calculate the absorbed energy ($E^p_{a,V}$) by work-hardening per unit volume fraction of the second phase formed in the metallic glass matrix composite prepared using each of the compositions. Particularly, since the hardness value of the second phase in the composite may be relatively measured as compared to the absorbed energy or the martensite-start temperature, work-hardening capacity of the composite may be controlled by calculating the absorbed energy ($E^p_{a,V}$) by work-hardening per unit volume fraction of the second phase formed in the metallic glass matrix composite prepared using each of the compositions.

In short, according to the exemplary embodiment of the present invention, there is provided a metallic glass matrix composite with controllable work-hardening capacity capable of having significantly excellent toughness due to the metastable second phase precipitated in-situ in the metallic glass matrix by polymorphic phase transformation during the solidification process without a separate synthetic process, and capable of controlling work-hardening capacity by adjusting the volume fraction of the second phase in the composite through measurement of the physical properties of the metastable B2 second phase and casting process control due to constant correlation between the physical properties (the absorbed energy $E^t_a$, the phase transformation temperature $T_{Ms}$, or the hardness $H_{2nd}$) of the metastable B2 second phase precipitated in the metallic glass matrix in the related composition region and the absorbed energy ($E^p_{a,V}$) by work-hardening per unit volume fraction of the second phase in the metallic glass matrix. The metallic glass matrix composite may contain about 35 to 58 at % of Ti, about 35 to 50 at % of Cu, about 4.5 to 12 at % of Ni, and about 0.5 to 5 at % of Si, and further contain one or more elements selected from Zr, Hf, V, Nb, Ta, Nb, and Cr, which are early transition metals (ETM), and Al and Sn, which are post transition metals (PTM), in a range of about 1 to 15 at %.

Hereinabove, the exemplary embodiments of the present invention have been disclosed for illustrative purposes, and those skilled in the art will appreciate that various modification are possible without departing from the technical spirit of the present invention. Therefore, the scope of the present invention should analyzed by the appended claims without the exemplary embodiments, and it should be analyzed that all spirits within a scope equivalent thereto are included in the appended claims of the present invention.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims.

What is claimed is:

1. A method for manufacturing a metallic glass composite with controllable work-hardening capacity, the metallic glass composite comprising a metallic glass matrix, and a phase-transformable metastable B2 second phase precipitated in the metallic glass matrix by polymorphic phase transformation, the method comprising:

casting an injected molten metal comprising the metallic glass matrix using arc plasma having output power of about 5 V to about 50 V (output voltage) and about 30 A to about 300 A (output current), and controlling the work-hardening capacity by adjusting at least one of absorbed energy ($E^t_a$), a phase transformation temperature ($T_{Ms}$), or hardness ($H_{2nd}$) to satisfy at least one of the following conditions, wherein:

absorbed energy ($E^p_{a,v}$) by work-hardening per unit volume fraction of the phase-transformable metastable B2 second phase in the metallic glass matrix and the absorbed energy ($E^t_a$) of the phase-transformable metastable B2 second phase satisfy the following Equation:

$$E^p_{a,v}=A_0E^t_a-B_0$$

($A_0$=about 5(±0.5)/$10^3$, $B_0$=about 6(±3)/$10^2$)unit: $E^p_{a,v}$(J/$cm^3$vol %), $E^t_a$(J/$cm^3$), the absorbed energy ($E^p_{a,v}$) by work-hardening per unit volume fraction of the phase-transformable metastable B2 second phase in the metallic glass matrix and the martensite-start temperature ($T_{Ms}$) of the phase-transformable metastable B2 second phase satisfy the following Equation:

$$E^p_{a,v}=C_0T_{Ms}-D_0$$

($C_0$=about 2.6(±0.2)/$10^3$, $D_0$=about 1.6(±0.2)/10)

unit: $E^p_{a,v}$(J/$cm^3$vol %), $T_{Ms}$(K), the absorbed energy ($E^p_{a,v}$) by work-hardening per unit volume fraction of the phase-transformable metastable B2 second phase in the metallic glass matrix and the hardness value ($H_{2nd}$) of the phase-transformable metastable B2 second phase satisfy the following Equation:

$$E^p_{a,v}=E_0H_{2nd}+F_0$$

($E_0$=about −5(±0.5)/$10^3$, $F_0$=about 2.7(±0.5)

unit: $E^p_{a,v}$(J/$cm^3$vol %), $H_{2nd}$(HV), or the hardness value ($H_{2nd}$) of the phase-transformable metastable B2 second phase and the martensite-start temperature ($T_{Ms}$) thereof satisfy the following Equation:

$$H_{2nd}=\text{about } 469.6\pm10-0.33\pm0.1T_{Ms}$$

unit: $H_{2nd}$(HV), $T_{Ms}$(K).

2. The method of claim 1, wherein:

the metallic glass matrix comprises about 35 at % to about 58 at % of Ti, about 35 at % to about 50 at % of Cu, about 4.5 at % to about 12 at % of Ni, and about 0.5 at % to about 5 at % of Si.

3. The method of claim 2, wherein:

the metallic glass matrix further comprises one or more elements selected from the group consisting of Zr, Hf, V, Nb, Ta, Cr, Al and Sn in a range of about 1 at % to about 15 at %.

4. The method of claim 1, further comprising:

controlling a volume fraction of the phase-transformable metastable B2 second phase in the metallic glass matrix through a suction casting process.

5. The method of claim 1, wherein:

the casting the injected molten metal comprises introducing a molten metal into a mold by a pressure of about 0 torr to about 600 torr.

6. The method of claim 1, wherein:

the casting the injected molten metal comprises adjusting cooling capacity in a range of about $10^1$ K/s to about $10^4$ K/s.

7. A method for manufacturing a metallic glass composite with controllable work-hardening capacity, the metallic glass composite comprising a metallic glass matrix, and a phase-transformable metastable B2 second phase precipitated in the metallic glass matrix by polymorphic phase transformation, the method comprising:

casting an injected molten metal comprising the metallic glass matrix using arc plasma having output power of about 5 V to about 50 V (output voltage) and about 30 A to about 300 A (output current), controlling the work-hardening capacity by adjusting at least one of absorbed energy ($E^t_a$), a phase transformation temperature ($T_{Ms}$), or hardness ($H_{2nd}$), and controlling a volume fraction of the phase-transformable metastable B2 second phase in the metallic glass matrix through a suction casting process.

* * * * *